US006375529B1

(12) United States Patent
Infante et al.

(10) Patent No.: US 6,375,529 B1
(45) Date of Patent: Apr. 23, 2002

(54) REVERSIBLE LIFE RAFT AND METHOD THEREFOR

(76) Inventors: Marisa Infante, 7260 NW. 68th St., Miami, FL (US) 33166-2014; Daniel Alvarez, 5670 NW. 116th Ave., Miami, FL (US) 33178; Alain Sosa, 2656 W. 72th Pl., Hialeah, FL (US) 33016; Marcos Lopez, 827 W. 38th Ter., Hialeah, FL (US) 33012

( * ) Notice: Subject to any disclaimer, the term of this patent is extended or adjusted under 35 U.S.C. 154(b) by 0 days.

(21) Appl. No.: 09/898,637

(22) Filed: Jul. 3, 2001

(51) Int. Cl.[7] ..... B63B 35/58
(52) U.S. Cl. ..... 441/38; 441/39; 441/40
(58) Field of Search ..... 441/38–43; 114/345, 114/362

(56) References Cited

U.S. PATENT DOCUMENTS

| | | | | |
|---|---|---|---|---|
| 3,574,875 A | * | 4/1971 | Tulett | 441/40 |
| 3,843,983 A | | 10/1974 | Tangen | 9/2 |
| 3,883,913 A | | 5/1975 | Givens | 9/11 |
| 4,001,905 A | | 1/1977 | Givens | 9/11 |
| 4,054,961 A | * | 10/1977 | Tangen | 441/39 |
| 4,517,914 A | | 5/1985 | Geracitano | 114/345 |
| 4,790,784 A | | 12/1988 | Givens | 441/40 |
| 5,733,158 A | | 3/1998 | Higginbotham et al. | 441/38 |
| 6,074,260 A | | 6/2000 | Harris et al. | 441/40 |
| 6,206,743 B1 | | 3/2001 | Martin | 441/37 |

* cited by examiner

*Primary Examiner*—Ed Swinehart
(74) *Attorney, Agent, or Firm*—Robert C. Kain, Jr.; Fleit, Kain; William Trueba

(57) ABSTRACT

The present invention is an inflatable, reversible life raft with a raft body including upper and lower inflatable, peripherally disposed bladders defining a closed geometric shape. The raft body also includes upper and lower inflatable masts in pneumatic communication with the upper and lower bladders, respectively. A floor closes the geometric shape between the upper and lower bladders. The upper and lower masts support upper and lower canopies, respectively. The upper canopy forms an upright, above-water enclosure to protect survivors from the elements. The lower canopy forms an underwater ballast beneath the floor of the raft, stabilizing the life raft. The reversible life raft is equipped with a reversible, collapsible ladder attached to an exterior portion of the two stacked bladders, and is equipped with two reversible ballast pouches mounted to an exterior portion of the two stacked bladders opposite the ladder. A method for establishing a reversible life raft for survivors in a body of water is also included.

32 Claims, 3 Drawing Sheets

REVERSIBLE LIFE RAFT AND METHOD THEREFOR

The present invention relates to a completely reversible life raft and method therefor.

BACKGROUND OF THE INVENTION

The prior art is replete with inflatable life rafts used in conjunction with aircraft and water craft in the event of an emergency on the water. The problem with the prior art is that deployment of the inflatable life raft includes a complicated protocol to ensure that the raft can be properly utilized by, the survivors, i.e. that the raft inflates upright. In an emergency situation, especially in the case of an emergency landing of an aircraft in a body of water, there is often times no time or no knowledgeable or trained staff available to ensure proper deployment of emergency rafts. Even when staff are available, the panic and rush for emergency exits do not allow for timely and orderly preparation of life rafts requiring a sequence of steps for proper upright deployment. There is a need in the industry for a reversible, inflatable life raft which can easily deployed without the requirement of a complicated set of instructions or protocol. There is a need for a reversible life raft which can be deployed in a simple manner by engaging an automation or activation device and allowing the raft to self-inflate.

U.S. Pat. No. 5,733,158 to Higginbotham, et al. discloses an inflatable reversible life raft having upper and lower canopies that are raised automatically above the upper and lower sides of the raft, respectively, depending on which side of the raft is facing upwardly when the raft is floating. The canopies are selectively raised by a generally vertically-oriented pillar slideably joined to the raft body, each end of the pillar being joined to corresponding upper and lower canopies.

OBJECTS OF THE INVENTION

It is an object of the present invention to provide a reversible inflatable life raft.

It is a further object of the present invention to provide a reversible life raft in which the upward facing side provides a shelter for survivors and the downward facing side provides a ballast underwater which stabilizes the life raft.

It is another object of the present invention to provide a reversible inflatable life raft with a mast and canopy on either side of the raft which image one another.

It is a further object of the present invention to provide a reversible life raft with a reversible, collapsible ladder which includes a platform.

It is another object of the present invention to provide a reversible inflatable life raft which includes reversible ballasts positioned opposite an entryway into the raft.

It is an object of the present invention to supply a method for establishing a reversible life raft for survivors in a body of water.

SUMMARY OF THE INVENTION

The present invention is an inflatable, reversible life raft with a raft body including upper and lower inflatable, peripherally disposed bladders defining a closed geometric shape. The raft body also includes upper and lower inflatable masts in pneumatic communication with the upper and lower bladders, respectively. A floor closes the geometric shape between the upper and lower bladders. The upper and lower masts support upper and lower canopies, respectively.

The upper canopy forms an upright, above-water enclosure to protect survivors from the elements. The lower canopy forms an underwater ballast beneath the floor of the raft, stabilizing the life raft. The reversible life raft is equipped with a reversible, collapsible ladder attached to an exterior portion of the two stacked bladders, and is equipped with two reversible ballast pouches mounted to an exterior portion of the two stacked bladders opposite the ladder. A method for establishing a reversible life raft for survivors in a body of water is also included.

BRIEF DESCRIPTION OF THE DRAWINGS

Further objects and advantages of the present invention can be found in the detailed description of the preferred embodiments when taken in conjunction with the accompanying drawings in which.

DETAILED DESCRIPTION OF THE PREFERRED EMBODIMENTS

The present invention relates to an inflatable, reversible life raft. The present invention provides a life raft which can be utilized under any number of emergency circumstances. However, its reversible design lends itself particularly well to aircraft emergency landings in bodies of water after which control over the proper deployment of emergency life rafts is almost impossible. The present invention solves the problem of assuring that the inflatable, emergency life raft lands upright, because the inflatable, reversible lift raft can be deployed in any position and it will function as intended. Thus, after an emergency landing, the emergency life raft need only be deployed, and the life raft will provide survivors a stable, safe location to await rescue.

The present invention features two stacked air bladders defining a closed geometric shape with a floor closing the shape between the stacked bladders. Above and below the two bladders are substantially similar respective canopies supported by corresponding inflatable masts pneumatically coupled to the upper and lower air bladders. The use of the terms "upper" and "lower" are relative to the body of water and used for reference. However, because the present invention is reversible, the "lower" component may become the "upper" component and vice versa if the raft is inverted. After deployment of the reversible life raft, the canopy above the water provides protection from the elements to the survivors inside, and the canopy below the water functions as a ballast, stabilizing the raft.

Figure 1:
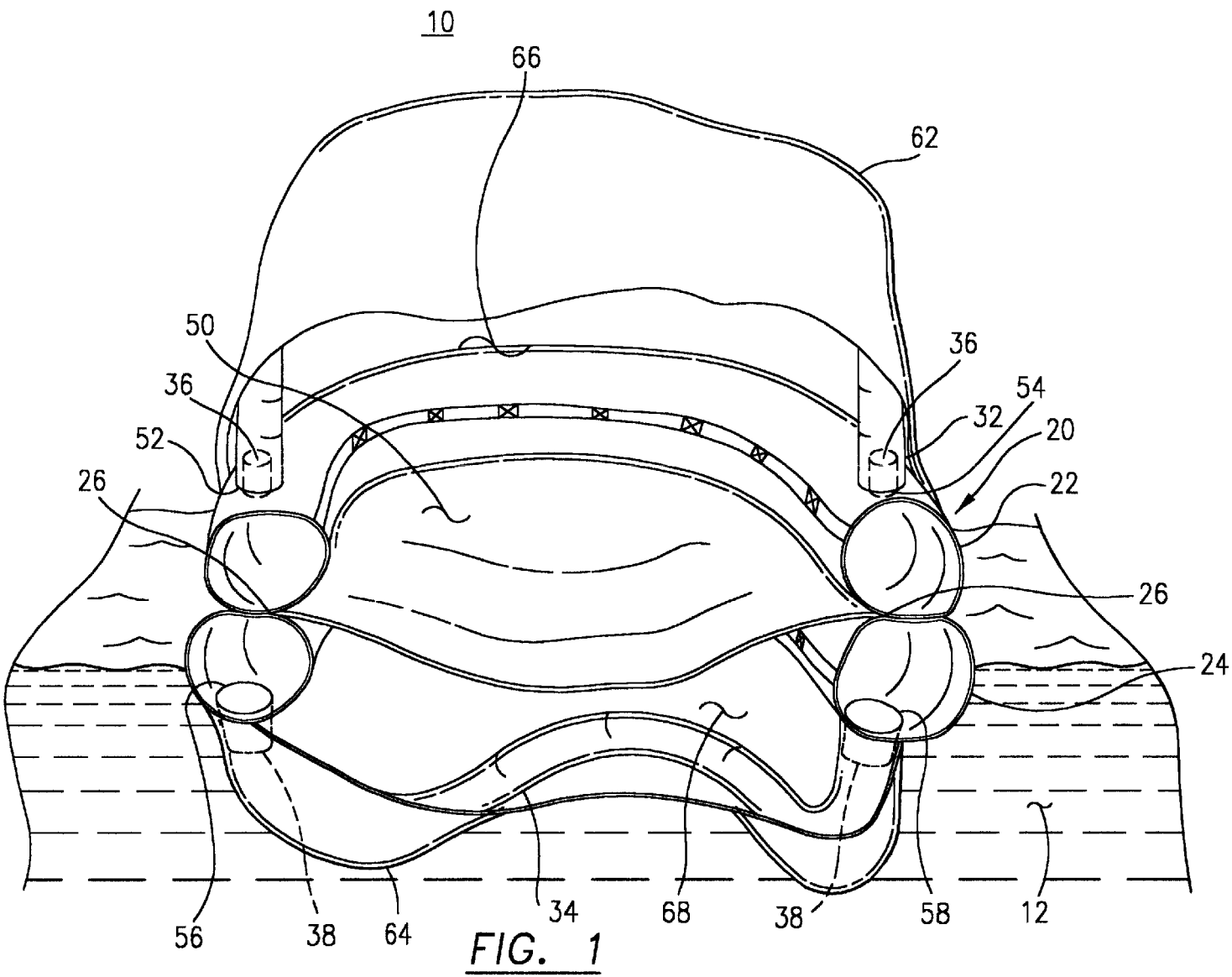
FIG. 1 diagrammatically illustrates a partial cross-sectional view of the reversible life raft in a body of water.

FIG. 1 diagrammatically illustrates a cross-sectional view of the reversible life raft 10 floating within a body of water 12. The inflatable, reversible life raft 10 is made up of a self-inflatable raft body 20 with stacked, peripherally disposed upper and lower inflatable bladders 22, 24. The inflatable raft body 20 also includes first and second inflatable masts 32, 34 in pneumatic communication with upper and lower inflatable bladders 22, 24, respectively. First and second inflatable masts 32, 34 may also be viewed as upper and lower inflatable masts, respectively. The peripherally disposed upper and lower bladders 22, 24 can be pneumatically coupled or connected, i.e. share the same gas contained within its bladder walls. However, in the preferred embodiment, the upper and lower bladders 22, 24 are independent such that gas cannot flow from one bladder to the other or vice versa. The separation of the gas contained within the two air bladders 22, 24 provides a higher degree of reliability of the reversible life raft in the event one of the two air bladders is punctured or damaged. Similar reference numbers designate similar items throughout the drawings.

The peripherally disposed bladders 22, 24 that make up part of the raft body 20 define a closed geometric shape. In FIG. 1, bladders 22 and 24 have a toroidal shape or donut shape. However, the geometric shape may be polygonal, such as hexagonal or octagonal. In FIG. 1, the bladders 22, 24 have a circular cross-sectional shape. The bladders 22, 24 may also have a cross-sectional polygonal shape.

The floor 50 spans across the bladders 22, 24, and attaches to the life raft 10 between the upper and lower bladders 22, 24 at seam 26. Thus, the floor 50 closes the geometric shape of the upper and lower bladders 22, 24.

The inflatable masts 32, 34 are pneumatically coupled or connected to respective gas bladders 22, 24. In FIG. 1, mast 32 has an inverted or downward facing U-shape and is pneumatically coupled to upper bladder 22 at opposing peripheral locations or at intersections 52 and 54. Similarly, mast 34 has a U-shape and is coupled to bladder 24 at opposing peripheral locations or at intersections 56 and 58. In FIG. 1, the buoyancy of mast 34 has caused part of the center of the mast to slightly rise. The pneumatic communication between the upper bladder 22 and upper mast 32, and lower bladder 24 and lower mast 34, may also include respective one-way pneumatic valves or check valves 36, 38 to prohibit gas flow from an inflated mast back into its corresponding bladder (see FIG. 1). The purpose of the one-way pneumatic valves 36, 38 is to compartmentalize the raft such that the raft remains viable, in the event one of the bladders 22, 24 is damaged. For example, if the upper bladder 22 is damaged, the survivors inside the life raft 10 would be able to repair the bladder while protected from the elements because upper mast 32 would be sustaining the upper canopy.

Each respective inflatable mast 32, 34 supports a corresponding canopy 62, 64. In FIG. 1, upper canopy 62 is supported by mast 32, and lower canopy 64 is supported by mast 34. The upper and lower canopies 62, 64 mirror each other. The canopies 62, 64 may be attached to the corresponding masts 32, 34 at one or more locations, may be attached to the corresponding bladder 22, 24 at one or more locations, or may be fastened to each other across the exterior of the two stacked bladders 22, 24 (see FIG. 2) and thus not requiring attachment to any part of the reversible life raft 10.

When the first upper or top canopy 62 is deployed, it forms an upright, above-water enclosure 66. The above-water enclosure 66 may be a partial enclosure and provides a shelter for survivors. The upper canopy 62 protects the survivors from the outside elements, including the wind, rainstorms and the sun. Upon deployment, the second lower or bottom canopy 64 forms an underwater enclosure or chamber 68 beneath the floor 50. During deployment of the second canopy 64, the underwater enclosure 68 fills with water. The lower canopy 64 restricts the free flow of water through the enclosure 68, and thus, provides resistance to movement of the reversible life raft 10. Whether the movement of the life raft 10 is caused by persons shifting positions on the floor 50 of the raft 10 in the above-water enclosure 66, or by waves pushing against the exterior of the raft, or even by the wind blowing against the upper canopy 62, the lower canopy 64 functions as a keel, ballast, and sea anchor, stabilizing the raft 10. The lower canopy 64 offers resistance to rocking motion, provides a ballast to prevent the life raft 10 from flipping (e.g. from wave motion), and provides an underwater drag to retard the drifting of the life raft due to strong winds. The sea anchor characteristic of the lower canopy 64 is an important feature to rescue operations because it helps to keep multiple life rafts in close proximity to each other.

Figure 2:
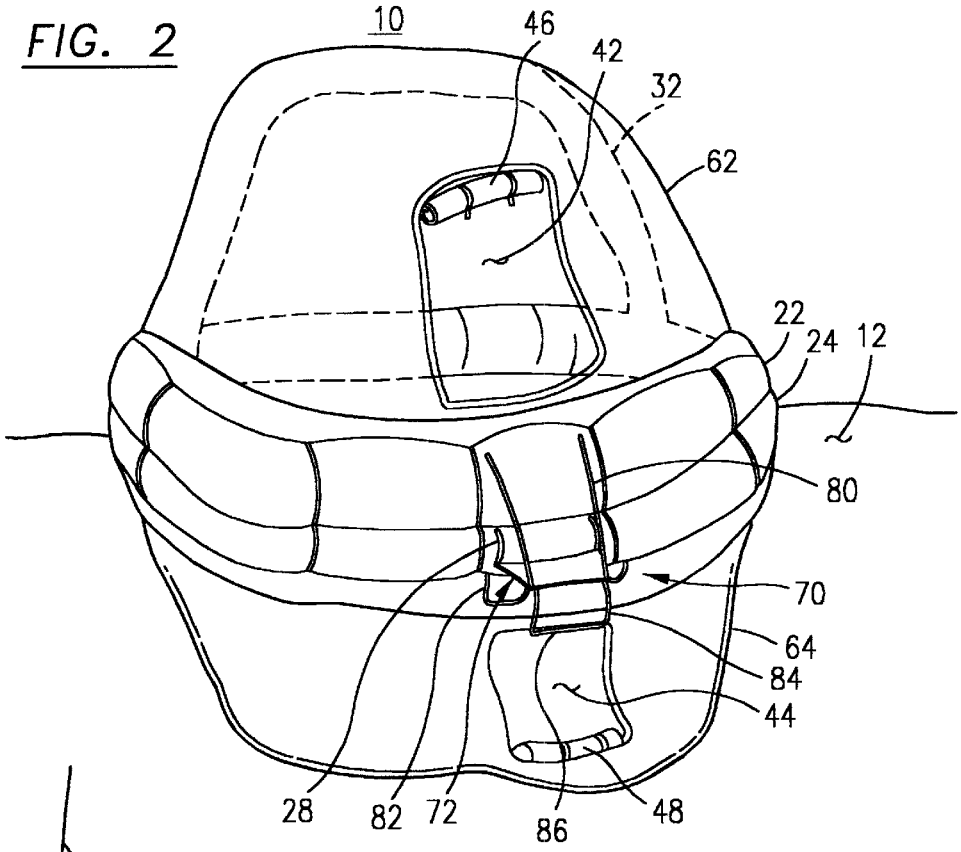
FIG. 2 diagrammatically illustrates a side view of the reversible life raft in a body of water.

FIG. 2 diagrammatically illustrates a side view of the reversible life raft 10. The upper and lower canopies 62, 64 define upper and lower openings or entryways 42, 44, respectively, with foldable flaps 46, 48. The upper entryway 42 and its corresponding foldable flap 46 are large enough to allow an adult to ingress and egress through the opening. The lower opening 44 is the same size as the upper opening 42. Both openings are located adjacent the reversible, collapsible ladder 70.

Figure 4A:
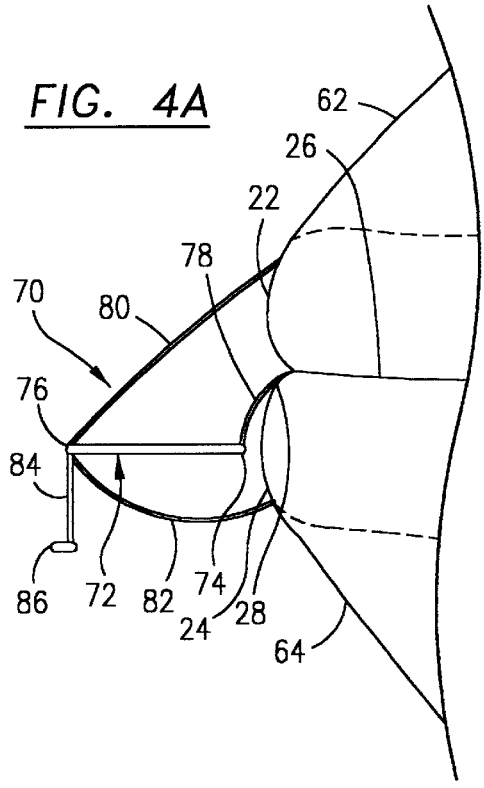
FIGS. 4A and 4B diagrammatically illustrate the reversible collapsing ladder.
Figure 4B:
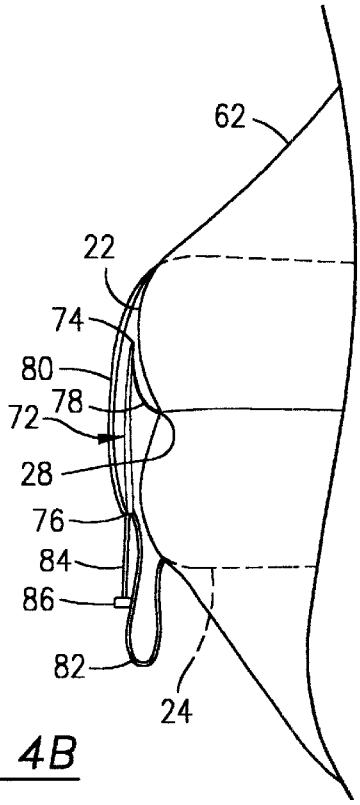

The reversible, collapsible ladder 70 is illustrated in FIGS. 2, 4A and 4B. The collapsible ladder 70 is attached to an exterior portion of the upper and lower bladders 22, 24 by an A-frame-type structure. The reversible, collapsible ladder 70 includes an outboard ledge or platform 72 which extends out from the raft and is approximately parallel with the water's surface when deployed. The platform 72 is semi-rigid and can be constructed from a solid material as illustrated in FIG. 2, or can be constructed of a fabric-like web. The proximal end 74 or the edge of the platform 72 closest to the exterior of the bladders 22, 24, is coupled via a flexible link 78 to an area 28 at or near an intersection between the upper and lower bladders 22, 24. The flexible link 78 permits the platform 72 to drop near the surface of the water to give persons attempting to embark the life raft 10 easier access into the raft. Depending upon how the reversible life raft deploys, the proximal end 74 of platform 72 rests against an exterior portion of the lower one of bladders 24, 22 away from the intersection 28 of the two bladders. In FIGS. 2 and 4A, proximal edge 74 is illustrated at or near lower bladder 24. The distal end or outboard edge 76 of platform 72 is coupled via upper and lower flexible straps 80, 82, to upper and lower areas on the upper and lower bladders 22, 24, respectively. Straps 80, 82 make up the sides of the A-frame structure of the flexible ladder 70. In FIGS. 2 and 4A, upper flexible strap 80 is taut or stretched out, and lower flexible strap 82 is loosely hanging. If the reversible raft 10 is inverted, lower strap 82 becomes taut and upper strap 80 becomes loose. The A-frame type straps 80, 82 each represent a pair of straps disposed at the left and right sides of the platform 72. See FIG. 2.

The reversible, collapsible ladder 70 may also include a lower rung 86 hanging below the distal end 76 of platform 72 via flexible rung straps 84 attached at or near the distal end 76 of platform 72. The flexible rung straps 84 permit the lower rung 86 to hang below platform 72 even if the reversible life raft 10 is inverted.

FIG. 4B diagrammatically illustrates the reversible, collapsible ladder 70 in the collapsed state. The ladder 70 may be collapsed by pulling up on proximal end 74 towards the top of upper bladder 22. This motion enables the semi-rigid platform 72 to swivel or fall downward, causing distal edge 76 to come to rest at or near the exterior of lower bladder 24. Other configurations of the reversible, collapsible ladder are possible.

Figure 3:
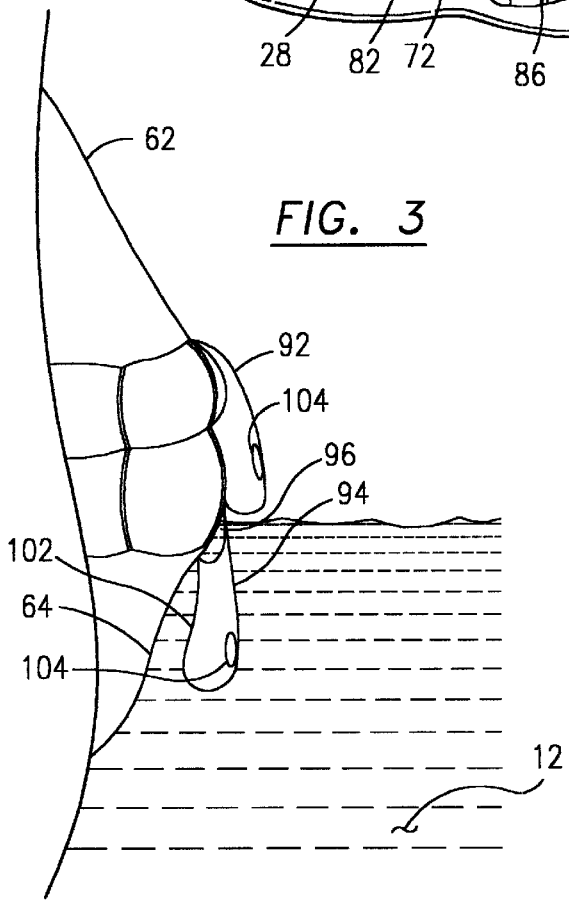
FIG. 3 diagrammatically illustrates a partial side view of the life raft with its ballast pouches attached to an exterior portion of the peripherally disposed inflatable bladders.
Figure 5A:
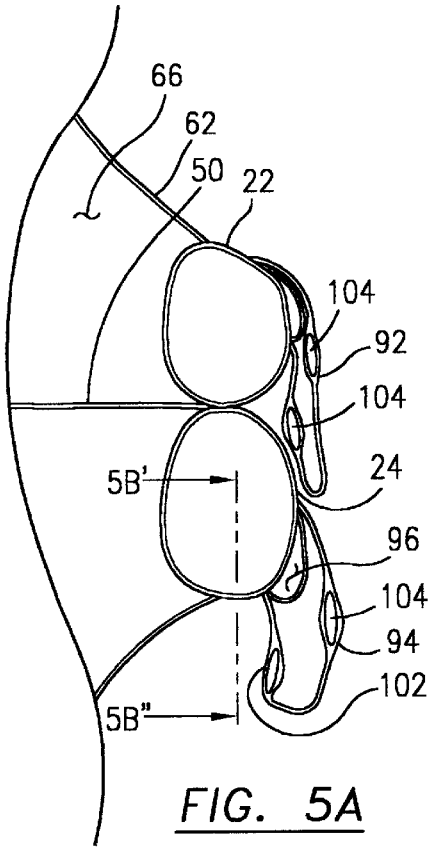
FIG. 5A diagrammatically illustrates a partial cross-sectional view of the reversible life raft with its ballast pouches attached to an exterior portion of the stacked, upper and lower inflatable bladders.

The reversible life raft 10 also includes reversible upper and lower ballast pouches or bags 92, 94 (see FIGS. 3 and 5A). The ballast bags 92, 94 are attached to an exterior portion of the upper and lower bladders 22, 24, respectively, at a location opposite the reversible, collapsible ladder 70. The ballast bags 92, 94 provide a counterweight at the opposite end of the entry point of the life raft 10 to prevent the raft from flipping or severely tilting during embarking and disembarking. The lower ballast pouch 94 is substantially submerged in the waters surrounding the raft 10. Because the pouch 94 defines a pouch-like container with openings 96 at either side and multiple openings 98 on the inboard face 102, the pouch fills with water during deployment of the raft 10. When a person climbs ladder 70 to enter the life raft 10, the downward force of the person's weight at the entry point of the raft 10 causes the area surrounding the entry point to slightly submerge into the water. The water under the raft 10 acts as a fulcrum causing the opposite end of the raft to rise. The weight of the water retained in the ballast pouch 94 provides a counterweight to prevent the raft from rising too much and flipping. Testing reveals that over 350 pounds can be balanced at the entry point by ballast bag 94.

FIG. 5A diagrammatically illustrates a side view of the reversible life raft 10 with ballast pouches 92, 94. A plurality of weights 104 positioned on the pouches 92, 94 allow the lower pouch 94 to open such that the submerged pouch 94 retains water. In addition to the weight of the water retained within ballast pouch 94, the weights 104 attached to both ballast pouches 92, 94 provide additional counterweight to counteract the force of the weight of persons entering and exiting the reversible life raft 10.

Figure 5B:
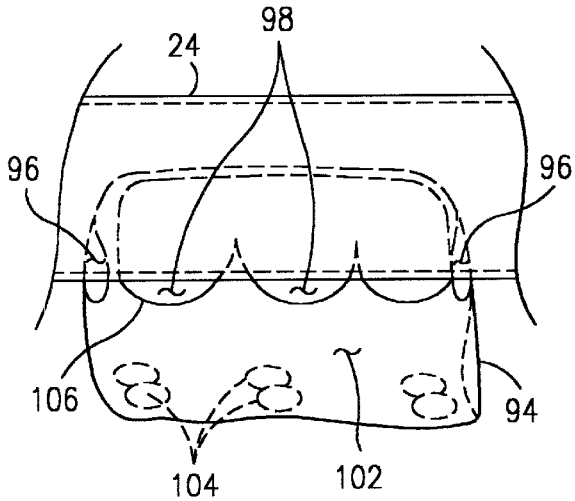
FIG. 5B diagrammatically illustrates a view of the lower ballast pouch from the perspective of section line 5B'–5B" in FIG. 5A.

FIG. 5B diagrammatically illustrates the lower ballast pouch 94 from the perspective of section line 5B'–5B" in FIG. 5A. Lower pouch 94 includes a scalloped inboard face 102. The scalloped edge 106 defines multiple openings 98 to allow water to flow into the lower pouch 94 during deployment of the life raft 10.

The reversible life raft 10 is ideal for use by the airlines as emergency life rafts in the event of an emergency landing in a body of water. The reversible life raft 10 includes pressurized gas containers (not shown), typically storing carbon dioxide ($CO_2$), attached to the reversible life raft, which are utilized to fill the raft body 20 during deployment (typically less than 60 seconds). Such pressurized gas containers and quick deployment systems are known in the art. Upon making an emergency landing, the reversible life rafts 10 stored aboard the airliner are taken out and deployed. A rip cord or similar activation device is used to begin inflation of the raft 10. Upon activation, the raft body 20, including upper and lower bladders 22, 24 and respective masts 32, 34 begin inflating simultaneously. Depending upon how the reversible life lands, the canopy on the water (facing down) or lower side of the raft deploys into the water. As the underwater deployed mast fills with gas and the lower canopy 64 is unfurled, water fills the cavity or chamber 68 defined by the canopy (FIG. 1), the lower bladder 24 and the floor 50. The capturing of a volume of water by the lower canopy 64 stabilizes the raft 10 as an underwater ballast. The upper canopy 62 deploys simultaneously with the lower canopy 64, and the upper canopy forms an upright, above-water enclosure 66. The reversible life raft includes the reversible, collapsible ladder 70 for entering the raft 10. On the opposite side of the raft 10 from the ladder 70 are two ballast pouches 92, 94 used to further stabilize the raft during the embarking and disembarking of passengers or survivors. The ballast pouches 92, 94 capture another volume of water to provide a counterweight at a location on the life raft opposite the reversible, collapsible ladder 70.

The claims appended hereto are meant to cover modifications and changes within the scope and spirit of the present invention.

What is claimed is:

1. A reversible life raft comprising:

a self-inflatable raft body with upper and lower inflatable, peripherally disposed bladders defining a closed geometric shape and first and second inflatable masts in pneumatic communication with said upper and lower bladders, respectively;

a floor closing said geometric shape of said upper and lower bladders;

first and second canopies supported by said first and second masts, respectively, such that said first canopy forms an upright, above-water enclosure and said second canopy forms an underwater ballast beneath said floor.

2. A reversible life raft as claimed in claim 1 wherein said inflatable bladders are stacked one atop the other.

3. A reversible life raft as claimed in claim 1 wherein said inflatable bladders and said inflatable masts are inflated simultaneously.

4. A reversible life raft as claimed in claim 1 wherein the first inflatable mast defines an inverted U-shape and the second inflatable mast defines a U-shape.

5. A reversible life raft as claimed in claim 1 wherein the first inflatable mast defines an inverted U-shape pneumatically coupled to opposing peripheral locations on said upper bladder and said second inflatable mast defines a U-shape pneumatically coupled to opposing peripheral locations on said lower bladder.

6. A reversible life raft as claimed in claim 1 further comprising a reversible, collapsible ladder attached to an exterior portion of said upper and lower bladders.

7. A reversible life raft as claimed in claim 6 further comprising upper and lower reversible ballast pouches attached to an exterior portion of said upper and lower bladders, respectively, at a location opposite said reversible, collapsible ladder.

8. A reversible life raft as claimed in claim 1 further comprising a reversible, collapsible ladder attached to an exterior portion of said upper and lower bladders, said ladder including an outboard platform having a proximal end coupled via a flexible link to an area at or near an intersection between said upper and lower bladders and having a distal end coupled via upper and lower flexible straps to upper and lower areas on said upper and lower bladders, respectively.

9. A reversible life raft as claimed in claim 8 wherein said ladder includes a lower rung hanging below said distal end of said platform via flexible rung straps attached at or near said distal end of said platform.

10. A reversible life raft as claimed in claim 8 further comprising upper and lower reversible ballast pouches attached to an exterior portion of said upper and lower bladders, respectively, at a location opposite said reversible, collapsible ladder.

11. A reversible life raft as claimed in claim 10 wherein said ballast pouches include a plurality of weights positioned on said pouches such that the lower submerged pouch retains water.

12. A reversible life raft as claimed in claim 1 wherein said pneumatic communication between said respective masts and corresponding bladders is via corresponding one-way pneumatic valves, each said valve prohibiting gas flow from said respective inflated mast to said corresponding bladder.

13. A reversible life raft as claimed in claim 6 wherein said canopies include a foldable flap large enough to allow ingress and egress for an adult therethrough, said flap located adjacent said collapsible ladder.

14. A reversible life raft as claimed in claim 1 wherein the respective canopies include corresponding entryways large enough to allow ingress and egress for an adult therethrough, and further comprising upper and lower reversible ballast pouches attached to an exterior portion of said upper and lower bladders, respectively, at a location opposite said entryways.

15. A reversible life raft as claimed in claim 2 wherein said inflatable bladders and said inflatable masts are inflated simultaneously.

16. A reversible raft as claimed in claim 15 wherein the first inflatable mast defines an inverted U-shape pneumatically coupled to opposing peripheral locations on said upper bladder and said second inflatable mast defines a U-shape pneumatically coupled to opposing peripheral locations on said lower bladder.

17. A reversible life raft as claimed in claim 16 further comprising a reversible, collapsible ladder attached to an exterior portion of said upper and lower bladders, said ladder including an outboard platform having a proximal end coupled via a flexible link to an area at or near an intersection between said upper and lower bladders and having a distal end coupled via upper and lower flexible straps to upper and lower areas on said upper and lower bladders, respectively, and said ladder including a lower rung hanging below said distal end of said platform via flexible rung straps attached at or near said distal end of said platform.

18. A reversible life raft as claimed in claim 17 further comprising upper and lower reversible ballast pouches attached to an exterior portion of said upper and lower bladders, respectively, at a location opposite said reversible, collapsible ladder.

19. A reversible life raft as claimed in claim 18 wherein said ballast pouches include a plurality of weights positioned on said pouches such that the lower submerged pouch retains water.

20. A reversible life raft as claimed in claim 19 wherein said pneumatic communication between said respective masts and corresponding bladders is via corresponding one-way pneumatic valves, each said valve prohibiting gas flow from said respective inflated mast to said corresponding bladder.

21. A reversible life raft as claimed in claim 20 wherein said canopies include a foldable flap large enough to allow ingress and egress for an adult therethrough, said flap located adjacent said collapsible ladder.

22. A reversible life raft comprising:

a self-inflatable raft body with upper and lower inflatable, peripherally disposed bladders defining a closed geometric shape and first and second inflatable masts in pneumatic communication with said upper and lower bladders, respectively;

a floor closing said geometric shape of said upper and lower bladders;

first and second canopies supported by said first and second masts, respectively, such that said first canopy forms an above-water enclosure and said second canopy deploys underwater beneath said floor due to inflation of said first and second masts.

23. A reversible life raft comprising:

a self-inflatable raft body with upper and lower inflatable, peripherally disposed bladders defining a closed geometric shape;

a floor closing said geometric shape of said upper and lower bladders;

a reversible, collapsible ladder attached to an exterior portion of said upper and lower bladders, said ladder including an outboard platform having a proximal end coupled via a flexible link to an area at or near an intersection between said upper and lower bladders and having a distal end coupled via upper and lower flexible straps to upper and lower areas on said upper and lower bladders, respectively; and upper and lower reversible ballast pouches attached to an exterior portion of said upper and lower bladders, respectively, at a location opposite said reversible, collapsible ladder.

24. A reversible life raft as claimed in claim 23 wherein said reversible, collapsible ladder includes a lower rung hanging below said distal end of said platform via flexible rung straps attached at or near said distal end of said platform.

25. A reversible life raft comprising:

a self-inflatable raft body with upper and lower inflatable, peripherally disposed bladders defining a closed geometric shape;

a floor closing said geometric shape of said upper and lower bladders; and a reversible, collapsible ladder attached to an exterior portion of said upper and lower bladders, said ladder including an outboard platform having a proximal end coupled via a flexible link to an area at or near an intersection between said upper and lower bladders and having a distal end coupled via upper and lower flexible straps to upper and lower areas on said upper and lower bladders, respectively.

26. A reversible life raft as claimed in claim 25 wherein said reversible, collapsible ladder includes a lower rung hanging below said distal end of said platform via flexible rung straps attached at or near said distal end of said platform.

27. A method for establishing a reversible life raft for survivors in a body of water comprising:

inflating upper and lower inflatable bladders;

simultaneously inflating upper and lower inflatable masts pneumatically coupled to said upper and lower bladders;

deploying first and second canopies via inflation of said first and second masts respectively above-water and below water;

stabilizing said life raft with said below water deployed canopy.

28. A method as claimed in claim 27 wherein said stabilizing step includes the step of capturing a volume of water with said underwater canopy.

29. A method as claimed in claim 27 further comprising the step of equipping said life raft with a reversible, collapsible ladder for entering said life raft.

30. A method as claimed in claim 29 wherein said stabilizing step includes capturing another volume of water at a location on said life raft opposite said reversible, collapsible ladder.

31. A method as claimed in claim 28 further comprising the step of equipping said life raft with a reversible, collapsible ladder for entering said life raft.

32. A method as claimed in claim 31 wherein said stabilizing step includes capturing another volume of water at a location on said life raft opposite said reversible, collapsible ladder.

* * * * *